US006057776A

United States Patent [19]

Sargent

[11] Patent Number: 6,057,776

[45] Date of Patent: May 2, 2000

[54] LIGHT WORK MK2

[76] Inventor: Nigel Frederick Sargent, P.O. Box 3995, Federal Way, Wash. 98063-3995

[21] Appl. No.: 09/163,175

[22] Filed: Sep. 30, 1998

[51] Int. Cl.[7] ..... G08B 21/00

[52] U.S. Cl. ..... 340/644; 340/545.1; 340/656

[58] Field of Search ..... 340/644, 654, 340/656, 545.1, 545.2, 548, 686.1; 362/294, 254, 260

[56] References Cited

U.S. PATENT DOCUMENTS

| | | | |
|---|---|---|---|
| 4,583,081 | 4/1986 | Schmitz | 340/545 |
| 4,705,484 | 11/1987 | Lerner et al. | 439/502 |
| 4,867,701 | 9/1989 | Wiand | 439/501 |
| 5,071,369 | 12/1991 | Luu | 439/501 |
| 5,234,360 | 8/1993 | Kramer, Jr. | 439/505 |
| 5,258,744 | 11/1993 | Zeder | 340/568 |
| 5,580,158 | 12/1996 | Aubrey et al. | 362/226 |
| 5,597,233 | 1/1997 | Lau | 362/294 |
| 5,650,771 | 7/1997 | Lee | 340/656 |
| 5,663,711 | 9/1997 | Sanders et al. | 340/635 |
| 5,716,125 | 2/1998 | Aubrey | 362/260 |

*Primary Examiner*—Jeffery A. Hofsass
*Assistant Examiner*—Toan Pham
*Attorney, Agent, or Firm*—Patent & Trademark Services; Thomas Zack; Joseph H. McGlynn

[57] ABSTRACT

An add-on housing circuit usable with an existing garage having a switch controlled overhead incandescent screw type lamp socket and a conventional remotely controlled garage door opener with the same type of incandescent lamp socket. This housing has internal circuitry and an outer display panel and is operatively connected to an added fluorescent lighting fixtures within the garage in place of the conventional incandescent bulbs in the garage and opener. Either one or two electrically operated garage door openers may be used with the housing and fluorescent lighting fixtures. The housing's display face has visual indicators which indicate that the existing garage wall switch is operating to supply power to a fluorescent lighting system or that electrical power from the existing garage opener is received. If two garage doors and openers are used, then an additional visual panel indicator to indicate the operative state of the second door with supporting internal housing circuitry included. Appropriate relay coils and contacts associated with the different visual indicators permit the controlling of electric power to the associated fluorescent lighting and housing visual indicators.

2 Claims, 5 Drawing Sheets

LIGHT WORK MK2

BACKGROUND OF THE INVENTION

Conventional garage door openers are usually provided with an overhead incandescent or filament lamp mounted near the door's lifting motor which are wired to be actuated when the door is opened. A timing circuit associated with the lamp allows the lamp to remain lit for a predetermined time interval before it is shut down. This time interval allows the user time to leave their vehicle and enter the house as light is provided. Normally, such door opener lighting systems have proven themselves suitable for their intended purpose.

There are, however, inherent drawback to such conventional lighting systems. Using incandescent lights requires the use of a relatively large amount of power with a resulting low output of radiated visible light. In contrast, using a rapid start fluorescent tubes consuming less electrical power can output more visible light per unit of input power. Thus, in place of a single 60 watt incandescent light bulb two sets of fluorescent shop lights (four tubes total) will not only consume less energy but give off more visible light. To permit the use of such fluorescent tubes compact conversion control units have been developed for use with conventional garage door openers as described thereafter.

DESCRIPTION OF THE PRIOR ART

Compact boxes associated with electrically operated devices are well known. For example, in U.S. Pat. No. 4,705,484 to Lerner et al. a container for a power cord wire and cable is disclosed which permits the shortening of the power cords to appliances, data processing workstations or with music reproduction systems.

In the Wiand reference (U.S. Pat. No. 4,867,701) an electric cable strip is disclosed which receives an oversized plug or adapter without interfering with the receipt of standard sized plugs by an adjacent outlet.

The Luu invention (U.S. Pat. No. 5,071,367) describes a power strip with an adjustable cord that is mounted in a perimeter edge groove.

In the Kramer, Jr. patent (U.S. Pat. No. 5,234,360) a flexible electric extension cord having a main cable with separate pigtails along its length and a plug connected at one cable end and a socket at the other cable end is disclosed.

The present invention differs from this cited art and the known prior art by providing for a light control box associated with a conventional garage door opener and powered by conventional household current that is used to control and indicate the operation of a fluorescent lighting system within the garage, whether the garage door is opened or closed, all as more fully set forth in this specification.

SUMMARY OF THE INVENTION

This invention relates to a housing or box associated with a fluorescent lighting system and a garage door opener. The box has visual power indicators which indicate either that a wall switch is operating and the fluorescent lighting is "on" or that one or two garage doors are operating while the fluorescent lighting is "on". Appropriate relay coil contacts associated with the different visual indicators permit the controlling of electric power to the associated fluorescent lighting.

It is the primary object of the present invention to provide for an improved electric lighting control apparatus used in conjunction with a garage door opener.

Another object is to provide for such an apparatus which can be used with either one or two garage door openers.

These and other objects and advantages of the present invention will become apparent to readers from a consideration of the ensuing description and the accompanying drawings.

DESCRIPTION OF THE PREFERRED EMBODIMENT

Figure 1:
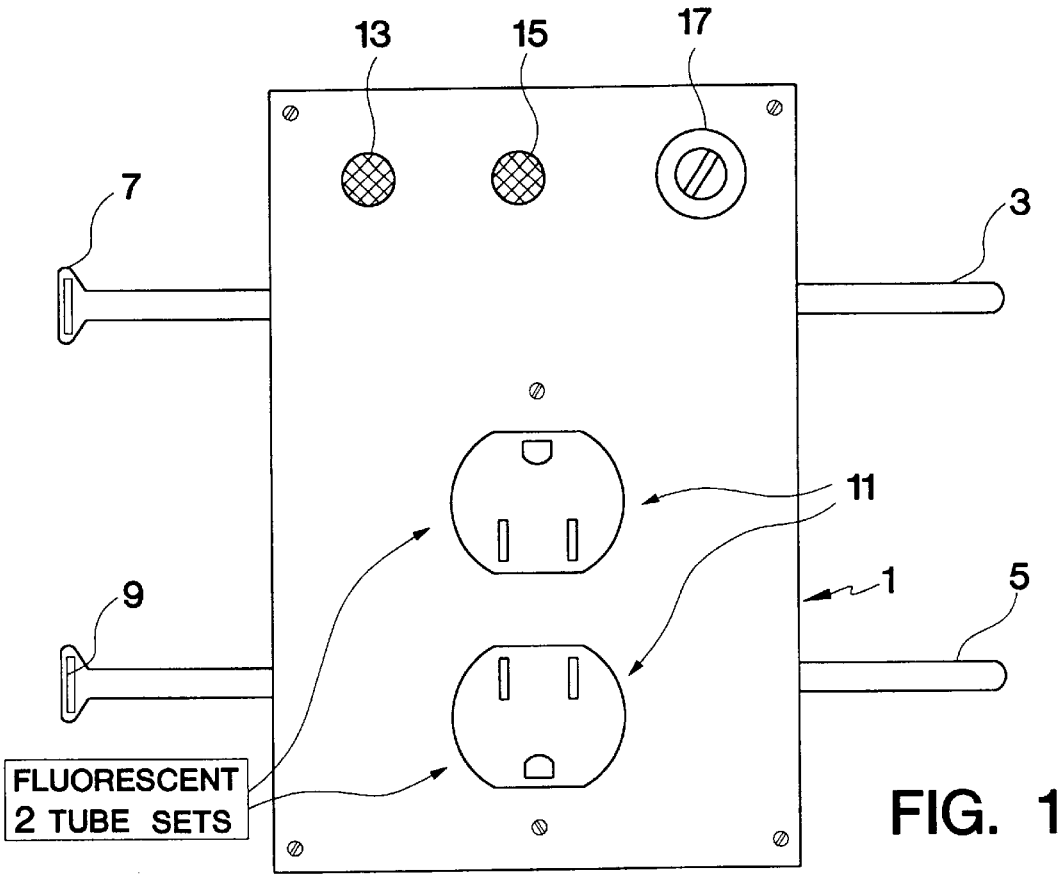
FIG. 1 is a top view of the display face of the invention's preferred embodiment control box used with a single garage door opener.

FIG. 1 is a top view of the display face of the invention's preferred embodiment control box 1 used with a single conventional garage door opener having a motor controlled signal receiver unit whose motion to open or close the door may be controlled by a remote transmitted signal from a transmitter normally carried in a vehicle. The rectangular control box 1 housing may be made of an approved metal or plastic material and has two spaced tie wrap straps 3 and 5 with end buckles 7 and 9. These straps are attached to the box's side opposite from the FIG. 1 displayed side and are used to fix the box to an area in the garage near the garage door opener. Usually this area is on the garage ceiling or a support structure within the garage for the door opener.

Also shown in FIG. 1 are two separate three prong electric outlets 11 each of which can be used to plug in conventional double tubed fluorescent maintenance lamp units as indicated by the outlined wording to the left. The upper neon bulb unit 13 is an indicating light that visually informs a user, when lit, that a wall switch and relay are operative and "on" and the two fluorescent light sets (4 tube bulbs total) are being supplied electric power. Adjacent this indicator 13 is the second visual indicator 15 associated with the garage door opener relay coil contacts. Indicator 15 indicates if the door is either opened or closed. To the right of this indicator 15 is a 115 volt, 83 ampere circuit fuse protector 17.

Figure 2:
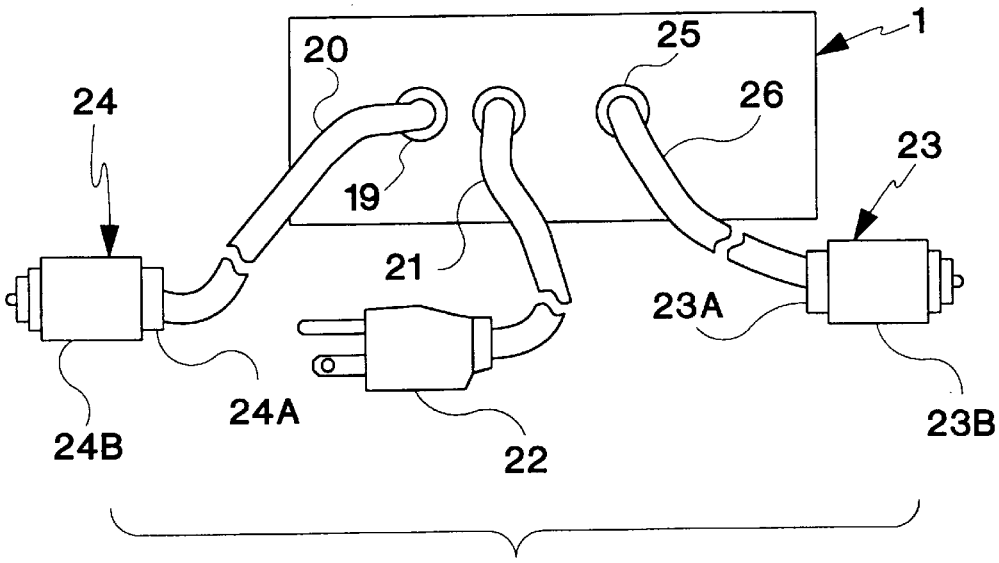
FIG. 2 is an end view of the FIG. 1 display face housing embodiment without its tie wrap straps and end buckles and with three added cable connectors.

FIG. 2 is an end view of the FIG. 1 display face control box 1 embodiment showing three added cable connectors and associated end cable members. The two spaced tie wrap straps 3 and 5 with end buckles 7 and 9 have been omitted from this view for simplicity purposes. To the left is the garage door lamp input power cable port 19 with its extending cable 20 connected to the garage door opener. At the free or outer end of cable 20 is the two component plug 24 made up of a conventional two prong outlet plug 24A and the separate engaged Lighting Screw adapter 24B. The outlet plug 24A may be a rubber side outlet plug such as the one in Cat. No. BP84W manufactured by the Eagle Electric Mfg. Co., Inc. of Long Island City, N.Y. An example, of a Lighting Screw 24B adapter is the socket adapter No. 835-125 made by the Leviton Mfg. Co. of Little Neck, N.Y. Adapter 24B permits the cable 20 and its plug end 24A to be electrically connected into a conventional screw type incandescent light bulb socket such as is conventionally found in the garage door opener unit. The center input power cable 21 is connectable via an end three prong power plug 22 to a conventional household power source such as a 115 alternating current (a.c.) voltage source also typically found in the ceiling of a garage. Further to the right on the housing end side is the box port 25 with its connecting cable 26 and free end adapter 23. Like adapter 24, cable adapter 23 comprises two engaged sub components one of which is the cable attached end outlet two prong plug 23A and the other of which is the engaged screw in Lighting Screw Adapter 23B. Lighting Screw Adapter 23B is screwed into an existing switch controlled overhead lighting fixture conventionally found in a garage whether or not an automatic garage door opener is present. The other Lighting screw adapter 24B is also electrically engaged by screwing it into the existing screw type lamp receptor (or bulb) socket of the garage door opener unit normally actuated when the garage door is opened by the opener's motor to emit light and then is cut off after a predetermined time interval after the door is closed.

Figure 3:
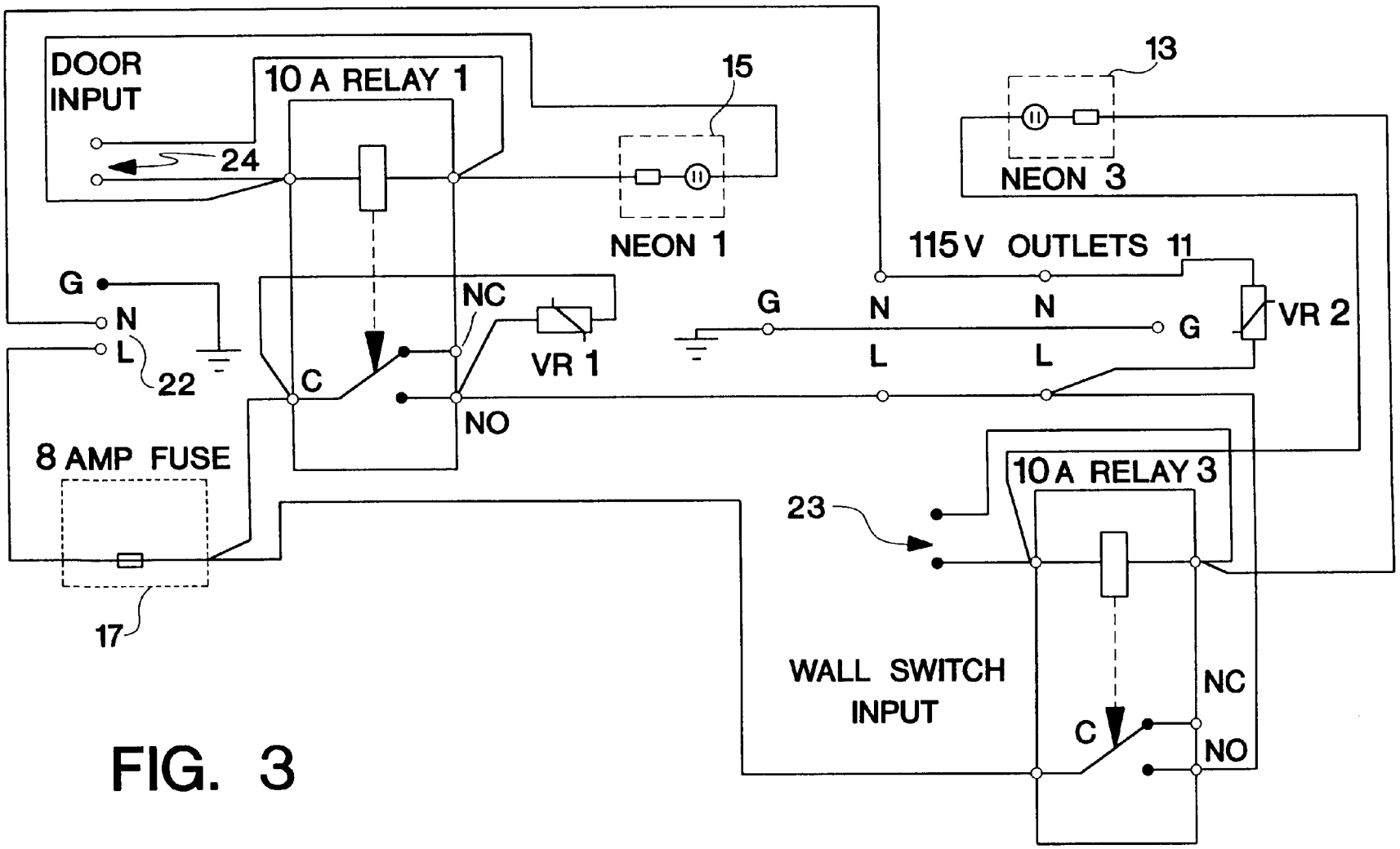
FIG. 3 shows the circuitry for the FIG. 1–2 embodiment.

FIG. 3 shows the circuitry for the FIG. 1–2 embodiment (or MK1 embodiment) used with a single garage door opener and garage door. Electric power from a conventional household power source, 115 volts and 10 amperes, is used to operate the circuit and inputted into the box 1 via cable 21. Such existing power inlets are conventionally found in the garage ceiling. The following abbreviations have been used in both the FIG. 3 and FIG. 6 circuits: C for common contact, NO for normally open contact, and NC for normally closed contacts. Each of the two illustrated neon lamps NEON 1 and NEON 3 have an internal resistor connected in series to the neon lamp bulb. An 8 ampere fuse 17 is interposed between the power source and the common contacts for the 10 ampere Relays 1 and 3, shown in FIG. 3 Varistors VR1 is connected across the common and normally opened contact for Relay 1 and 3, and varistor VR2 across the 115 volt outlet 11. Both varistors VR1 and VR2 provide transient spike protection to the circuit and its elements. When the garage door is opened, electrical signals normally supplied to the opener's lamp are now supplied, via the screw type adaptor and plug-cable assembly (24) to the coil of Relay 1. This power signal drives the relay coil and contacts and the neon 1 (15) to an "on" state which completes the circuit to the 115 volt outlet (11) and turns the connected fluorescent lamp units "on". With the normally existing garage ceiling bulb removed from its lamp socket and the screw adaptor and plug cable assembly 23 screwed into the socket in its place, the existing garage wall switch can be used to control input power at the terminal indicated.

To allow normal use of the fluorescent lamps without having to open the garage door each time, electrical supply port (25) can be used with the conventional garage wall light switch. When actuated, this drives Relay 3 coil and contacts and indicator NEON 3 (13) to an ON state, thus completing the circuit to the 115 volt outlets (see FIG. 1, with outlets 11), again, and turning the connected fluorescent lamps "ON".

The following shown electronic components are mounted on a printed circuit board: varistor VR1 and Relays 1 and 3. This same board also supports the shown interconnections for NEON 1 (15) and NEON 3 (13) and the following inputs: port for garage door (19), wall switch (input (25), 115 volt supply and the 115 volt input supply (via cable 21 with plug 22). The varistor VR2 is mounted directly across the 115 volt outlet (11) which in-turn is mounted to the metal front plate of the box 1, along with the components shown as NEON 3 indicator 13, NEON 1 indicator 15 and fuse protector 17.

Figure 4:
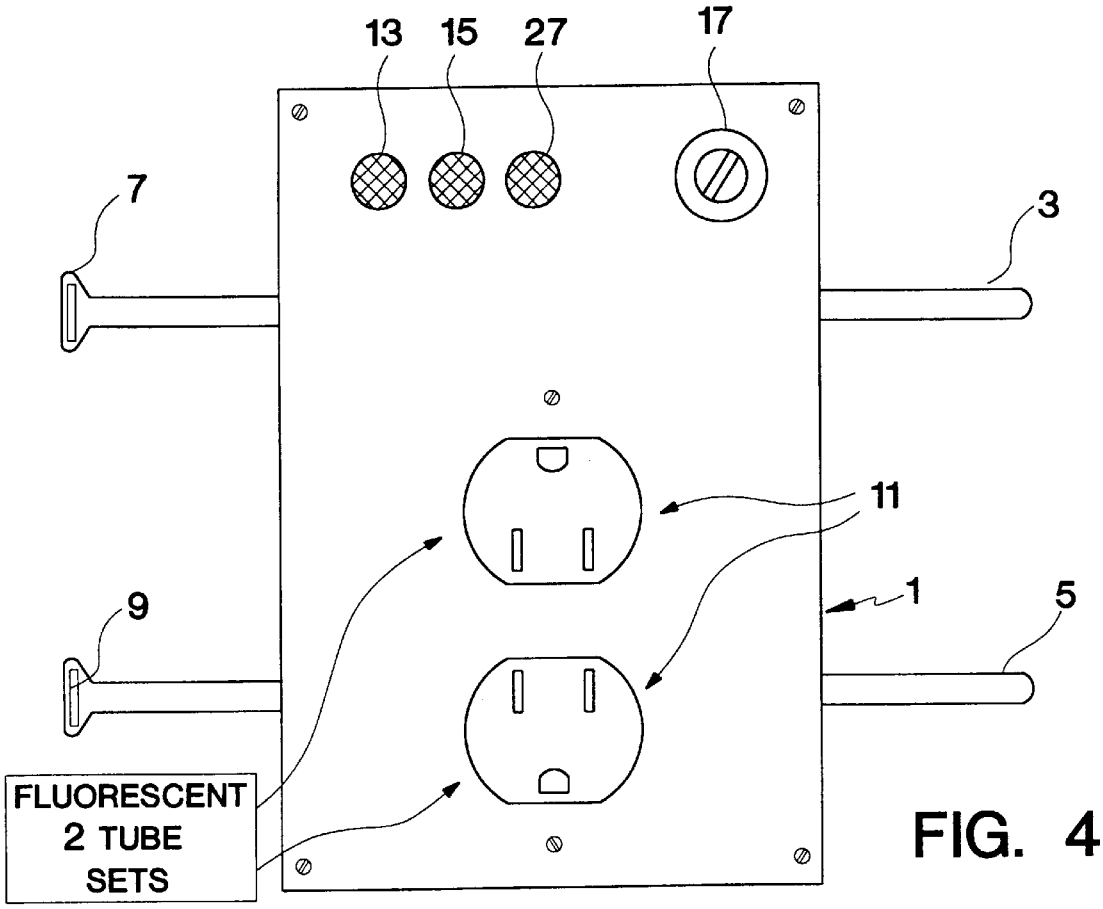
FIG. 4 is a top view of the display face of the invention's preferred embodiment used with two garage door openers.
Figure 5:
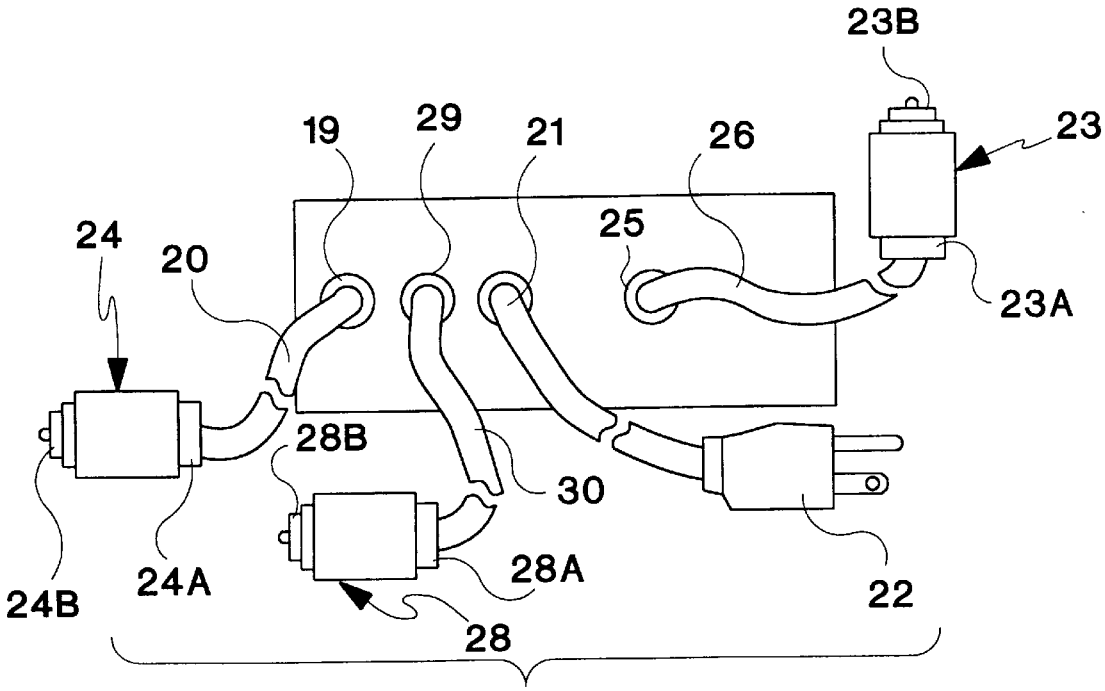
FIG. 5 is an end view of the FIG. 4 display face housing embodiment without its tie wrap straps and end buckles and with four added cable connectors.

FIG. 4 is a top view of the display face of the invention's preferred embodiment used with two garage door openers. This view is essentially the same as the FIG. 1 and the same numbers have been used to describe the same functioning components. The essential differences between the two embodiments in that in the FIG. 4 embodiment there is an additional neon lamp indicator 27 for the other or second door and in FIG. 5 there is an additional door lamp input port 29 with its cable 30 and Relay 2 and end lighting adaptor 28. This design for a two-garage door opener is arbitrarily referred to as an MK2 design while that for the first one-garage door opener is arbitrarily referred to as an MK1 design. FIG. 5 is an end view of the FIG. 4 display face box 1 embodiment with four cables added as shown with the various box inputs mentioned. The two spaced tie wrap straps 3 and 5 with end buckles 7 and 9 have been omitted from this view for simplicity purposes. The added power cable input port 29 with its extending cable 30 screwed into the second garage door opener. At the end of cable 30 is the two component plug 28 made up of a conventional two prong outlet plug 28A and a separate engage lighting screw adapter 28B, essentially the same type of adapter as used for the FIG. 2 components 24A and 24B.

Figure 6:
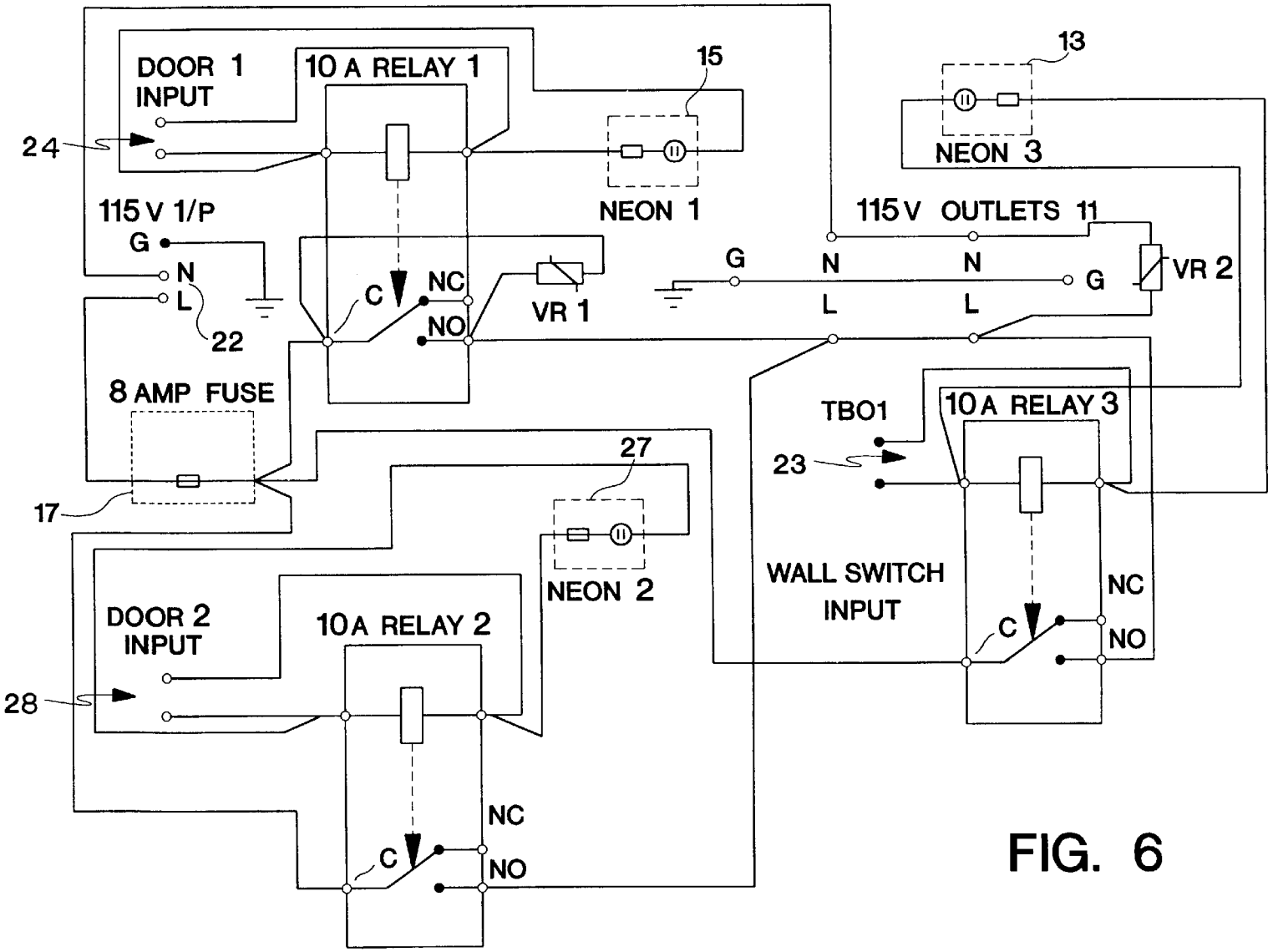
FIG. 6 shows the circuitry for the FIGS. 4–5 embodiment.

FIG. 6 shows the operating circuitry for the FIGS. 4–5 or MK2 two opener/two garage door embodiment. Each of the three shown neon lamps—NEON 1, NEON 2 and NEON 3—have an internal resistor connected in series to their respective neon lamp bulbs. The incoming electrical 115 volt supply (21) is received via a plug 22 and cable 21 from a typical household outlet such as is usually found in the garage ceiling. This supply is fused at 8 amperes (17) and supplies the common electrical contacts of the 10 ampere Relays 1, 2 and 3.

Varistors VR1 and VR2 fitted across , in the case of VR1, the common and normally opened contacts of Relays 1,2 3 and across the 115 volt outlet (11) for VR2. Both varistors provide transient spike protection to the circuit. When the first garage door is opened, the supply of electrical power is taken in place of the manufacturers supplied lamp, via the screw type adaptor and the cable 20 with its end adaptor (24), to the coil of Relay 1. This drives the coil and contacts of Relay 1 and the indicator NEON 1(15) "on". If the other second garage door is selected for operation, it also has its electrical supply taken from the manufacturers supplied lamp as stated above, via cable 30 and the shown screw type adaptor 28 connected to lamp input 29. This latter connection drives the Relay 2 coil and contacts and indicator NEON 2(shown as 27 in FIG. 4) thus completing the circuit to the 115 volt outlet receptors 11.

If either Relays 1 or 2 are selected for operation, this will cause the fluorescent lamp units to turn "on". To permit the normal actuation of the fluorescent lamp units without having to open the garage door (s) each time, a third input cable adaptor 23 via input port 25 and cable 26 is provided to the Relay 3 coil and the NEON 3(13) indicator. With the existing garage ceiling bulb removed and the screw adaptor and plug-cable adapter 23 added, the existing garage wall switch electrical supply can be used to control the coil and contacts of Relay 3, thus completing the circuit to the 115 volt outlets (11) again and turning the fluorescent lamps "on".

Figure 7:
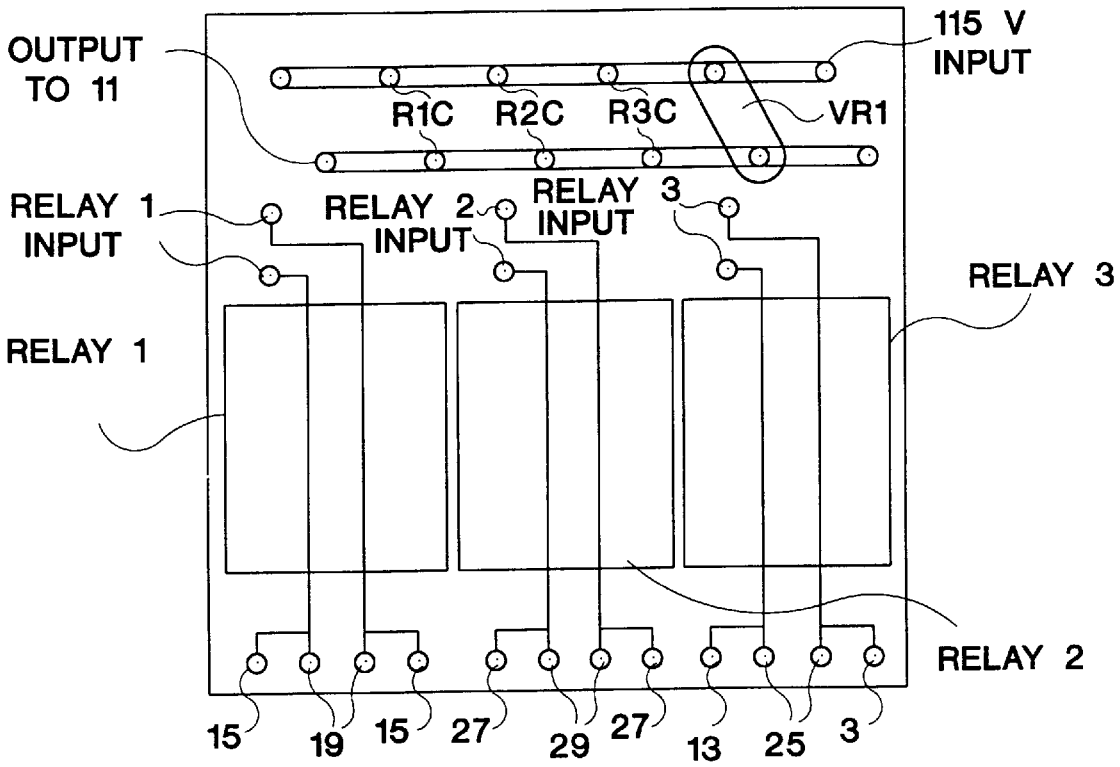
FIG. 7 shows the printed circuit board layout for either of the FIGS. 1–3 or FIGS. 4–6 embodiments.

The following electronic components are mounted on the shown FIG. 7 printed circuit board layout with interconnections: varistor VR1, Relays 1, 2 and 3. This same board also has all the interconnections for the two outputs for NEON 1 (15), NEON 2 (27) and NEON 3 (13) as shown in the lower board section. It also has a pair of depicted inputs between these lower board neon outputs as follows: first garage door opener (19), second garage door opener (29), existing garage wall switch input (25) and existing 115 volt electrical input via fuse 17 and plug 22 (upper right corner of the board). The Varistor VR1 is connected at two points. The first being the 115 volt input and the second point being the 115 volt output. This output is in-turn fed to the electrical output (11) which is mounted to the front plate from the box 1, along with the items (see FIG. 4) designated as NEON 3 (13), NEON 1 (15), NEON 2 (27) and FUSE 17. The normally opened and common contacts for each of the Relays 1,2 and 3 are shown in the upper board section and designated by the notations R1C, R2C and R3C, respectively, as shown.

FIG. 7 shows the printed circuit board layout and relay positions for either the FIG. 1–3 or FIG. 4–6 embodiments. If two relays are used, as in MK1 layout of FIG. 1–3, then only Relays 1 and 3 would be operative and fitted whereas if all three relays, as in the FIG. 4–6 embodiment, then all three of the shown relays including Relay 2 would be operative and fitted as in the MK2 layout.

In both the MK1 and MK2 embodiments, the major reason for interposing the housing 1 and its associated circuitry and components is to allow the garage to become better lit by using fluorescent lighting without having to do any additional wiring. This fluorescent lighting provides a good security device which allows a driver to see inside the garage before driving into it. The existing garage wall switch permits the fluorescent lighting to be controlled once inside the garage without having to open the garage door to have interior light in the garage . The total cost for all items needed to perform the stated functions is small and may be further reduced by either eliminating specific described items or by using alternate less expensive items. Relays, such as the Radio Shack relay 120 vac coil contact rated at 10 amps bearing part no 275-217c, utilized in the switching cycles described in place of solid state Triac since it was felt they offered greater current capability at less cost.

Other Radio Shack components that have been also been used in the same working embodiment include the following: (1) Fuse holder with a Max rating of 250 vac at 10 amps bearing part number 270-364c; (2) fuse rated at 120 vac at 8 amps bearing part number 270-1014; (3) neon lamps rated at 120 vac with internal resistor bearing part number 272-704b; (4) Varistor metal-Oxide max. voltage 246 vac bearing part number 276-568c; (5) Enclosure box 1 (15.9×9.6×5.0 cm) bearing part number 270-627 and (6) blank printed circuit board bearing part number 276-1499a.

Other possible variations include the removal of the fuse 17 from the front plate of the box 1 and fitting it directly on the printed circuit board shown in FIG. 7. This would allow a cheaper fuse holder to be used as well as saving on assembly time. Further, the three Neon lamps (13,15 and 27) could be removed as these have only been added to provide a visual reference. The box 1 would work correctly without such lamp indicators and eliminating them would save on assembly time.

Although the present invention's preferred embodiment and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A system for using fluorescent lighting with an existing garage having a remotely controlled garage door opener comprising in combination:

a garage having a garage door and a first incandescent screw type light bulb socket in the garage whose electrical operation is controlled by a switch;

a first electrically operated garage door opener mounted within said garage used to operate the garage door of said garage, said first garage door opener having a second incandescent bulb screw socket operatively responsive to the operation of the door opener;

a source of alternating electrical power having an outlet in the garage;

a fluorescent lighting fixture adapted to be electrically connected to a circuit housing mounted adjacent said first garage door opener;

a circuit housing electrically and operatively connected to said fluorescent lighting fixture, to said outlet of the source of electrical power, to said first incandescent screw type light bulb socket and to said second incandescent bulb screw socket of the first garage door opener;

said circuit housing having a display face with a plurality of different visual indicators, one of said visual indicators indicating that power is being supplied to operate the connected fluorescent lighting via said garage light bulb socket control switch and another of said visual indicators indicating the operative state of the operated garage door;

said circuit housing including electrical operated relays to permit the controlling of associated electric power to the connected fluorescent lighting fixture; and said circuit housing being portable and having means for removably attaching the circuit housing to the garage near the garage door opener.

2. The system as claimed in claim 1, also including a second garage door and a second electrically operated garage door opener associated with said second garage door, said second garage door opener having a third lamp screw socket for use with an incandescent bulb and being operatively connected into housing circuitry associated with said second garage door, said circuit housing face having additional visual indicators to indicate that this second garage door is operative, said additional visual indicators being operatively associated with said second door opener lamp socket of the second garage door.

* * * * *